US005563689A

United States Patent [19]

Tompkins et al.

[11] Patent Number: 5,563,689

[45] Date of Patent: Oct. 8, 1996

[54] DEVELOPER MODULE WITH ELECTROMAGNETIC SHUTTER

[75] Inventors: E. Neal Tompkins, Atlanta; Jack N. Bartholmae, Duluth; James W. O'Brien, Alpharetta, all of Ga.

[73] Assignee: T/R Systems, Norcross, Ga.

[21] Appl. No.: 451,910

[22] Filed: May 26, 1995

[51] Int. Cl.[6] ..... G03G 15/06

[52] U.S. Cl. ..... 355/253; 118/657

[58] Field of Search ..... 355/245, 253; 118/656, 657

[56] References Cited

U.S. PATENT DOCUMENTS

| | | | |
|---|---|---|---|
| 4,391,512 | 7/1983 | Nakamura et al. | 118/657 |
| 4,428,661 | 1/1984 | Masuda et al. | 355/251 |
| 4,431,298 | 2/1984 | Arai et al. | 355/246 |
| 4,637,706 | 1/1987 | Hosoi et al. | 355/253 X |
| 4,746,952 | 5/1988 | Kusuda et al. | 355/253 |
| 5,072,690 | 12/1991 | Ishikawa et al. | 118/657 X |

*Primary Examiner*—Nestor R. Ramirez
*Attorney, Agent, or Firm*—Gregory M. Howison

[57] ABSTRACT

An electromagnetic shutter (40) is comprised of two poles, a south pole (42) and a north pole (44) that are disposed above the surface of a delivery roller element (32). The delivery roller element (32) rotates about a fixed magnet (30) that has various poles. The south pole (42) of the electromagnetic shutter (40) is aligned proximate to the one of the north poles of the magnet (30). When the electromagnetic shutter (40) is activated with the windings (48) and (50) or winding (48) only, the shutter will form a magnetic dam (79) of toner particles which will effectively prevent passage of the toner particles thereby.

13 Claims, 5 Drawing Sheets

DEVELOPER MODULE WITH ELECTROMAGNETIC SHUTTER

TECHNICAL FIELD OF THE INVENTION

The present invention pertains in general to a developer module for an electrophotographic print engine, and more particularly, to the distribution of developer from the developer module.

BACKGROUND OF THE INVENTION

In electrophotographic print engines, a latent image is first formed on a photoconductive member, which latent image has areas of differing electrical properties such that, when the latent image is passed by a supply of electrostatically charged toner particles, these toner particles will adhere to specific locations providing a "developed" image. This developed image can then be transferred to an image surface, such as paper, or an intermediate transfer member. For color reproductions, it typically requires the development of the latent image with different color toner particles.

The toner supply mechanism or developer is typically a reservoir of toner material that is continually mixed and disposed on a roller that rotates in contact with the photoconductive member when the latent image is passed thereby. However, most color designs today typically provide some type of shutter mechanism for preventing toner from being presented to the photoconductive member when the latent image is not present, as this will merely be removed from the photoconductive member by a cleaning blade at a later stage.

Presently, there are several methods used to shutter the developer flow, primarily dealing with mechanical methods to restrict flow. Most of these methods utilize mechanical blades or moving magnets. The mechanical blades allow the developer to be removed from the surface of the roller, thus preventing the toner particles from being developed on the photoconductive member. Since the developer particles have magnetic properties and can align themselves in a magnetic field, some systems utilized a system of moving magnets to allow the toner particles to be moved in contact with the photoconductive member or be inhibited from being presented thereto. Still, others move the developer mechanism away from the photoconductive member to avoid development. The disadvantage to these prior art systems is that they utilize mechanical moving parts.

SUMMARY OF THE INVENTION

The present invention, disclosed and claimed herein, comprises a developer module with an electromagnetic shutter. The developer module is comprised of a sump housing that is operable to contain electrostatic toner particles. The sump housing has an open end disposed therein for interfacing with a photoconductive element that is operable to carry a latent image. A delivery device is disposed in this opening with a moving surface for conveying toner from the interior of the sump housing to the photoconductive element. The delivery device has a fixed magnetic device associated therewith with at least one pole of a first polarity fixed relative to the movement of the surface of the delivery device. A magnetic damming device is provided that is operable to selectively create a magnetic field in the path of the developer flow along the surface of the delivery device to create field lines that extend upward from the surface of the delivery device from the at least one pole of the fixed magnetic device such that the developer particles align themselves with the created magnetic field.

In another aspect of the present invention, the delivery device is comprised of the hollow cylindrical roller disposed about a cylindrical fixed magnet. The fixed magnet has various poles disposed therearound and extending radially outward from the center thereof. This allows the toner particles to be magnetically aligned along the surface of the roller as it rotates. The magnetic damming device is comprised of an electromagnet having at least one pole of a second and opposite polarity to the first polarity of the fixed magnet. This one pole of the damming device is disposed above the surface of the delivery device by a predetermined distance and is switchable.

In a further aspect of the present invention, a second pole is provided on the damming device of the first polarity that is spaced away from the first pole thereof a predetermined distance to create field lines substantially parallel to the surface of the delivery device. The first pole of the damming device is disposed in a position that lags the first pole of the fixed magnetic device. This allows a magnetic dam to be disposed such that it is at an angle less than 90° with respect to the flow of magnetic developer particles.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
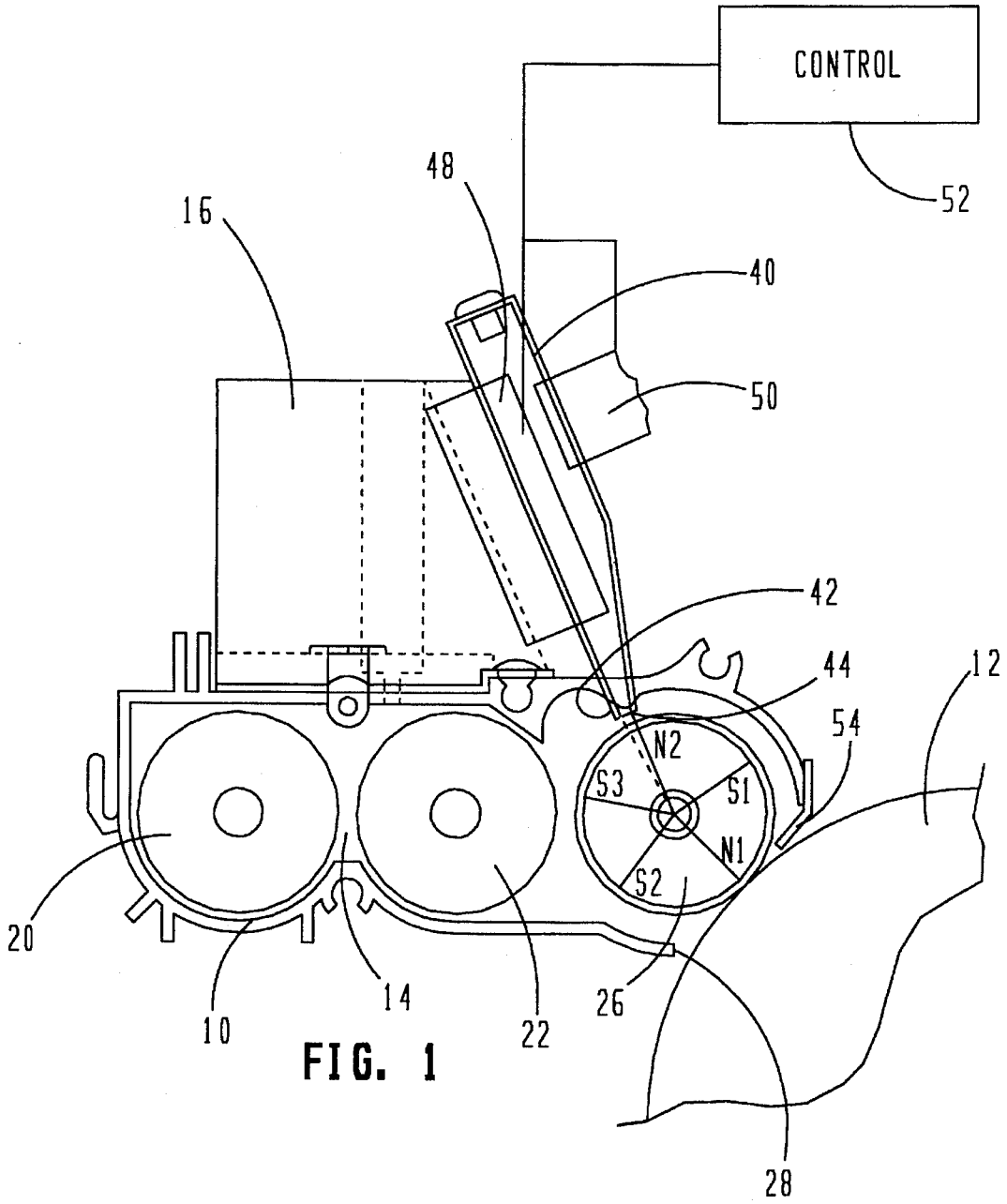
FIG. 1 illustrates a cross-sectional view of a developer module utilizing the electromagnetic shutter of the present invention.

Referring now to FIG. 1, there is illustrated a cross-sectional view of a toner module utilizing the electromagnetic shutter of the present invention. The toner particles are generally contained within a toner module housing 10 and it is operable to be disposed adjacent a photoconductor (PC) drum 12. However, it should be understood that any type of photoconductor member could be utilized, such as a belt, which would present a flat surface. The housing 10 includes a developer sump 14, which is operable to contain toner material which, for a black and white electrophotographic print engine would be black toner, and for a color print engine, could be one of multiple colors, magenta, cyan, yellow. Additional toner is contained within a toner reservoir 16, which is interfaced with the housing 10 such that toner would fall into the sump 14. The sump 14 is operable to contain the toner to be delivered to the surface of the PC drum 12. There are two stirring rollers 20 and 22 disposed within the sump 14 which are operable to ensure that the toner within the sump 14 is adequately uniform.

A delivery roller 26 is disposed on the end of the housing 10 proximate to an opening 28 within the housing 10. A portion of the roller 26 on the outer peripheral surface thereof extends outward from the opening 28 and is disposed proximate to the surface of the PC drum 12. The distance between the roller 26 and the PC drum 12 is sufficient to allow the properties of the latent image disposed on the surface of PC drum 12 to attract toner particles disposed on the surface of the delivery roller 26.

Figure 1A:
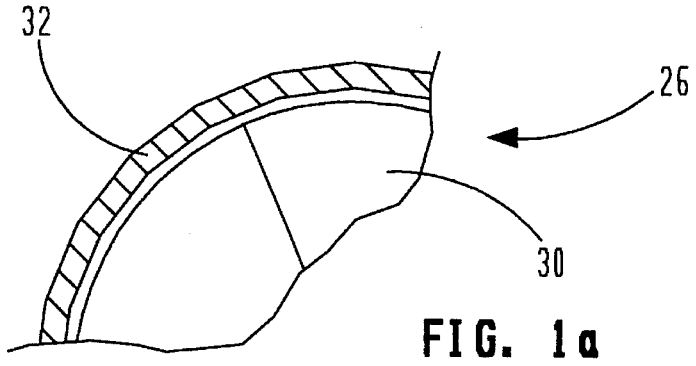
FIG. 1*a* illustrates a detail of the distribution roller and magnet.

A detail of the driving roller 26 is illustrated in FIG. 1*a*. The driving roller 26 is comprised of a permanent fixed magnet 30 that is "poled" such that there are various north and south poles disposed about the periphery thereof. The fixed magnet 30 is cylindrical in shape and has a hollow cylindrical outer roller member 32 manufactured from a material such as aluminum. This roller member 32 is rotatable such that it rotates at an equal or greater tangential speed as the surface of the PC drum 12 and in the opposite direction. In the embodiment illustrated in FIG. 1, the driving roller 26, rotates in a clockwise direction and the PC drum 12 rotates in a counter clockwise direction.

An electromagnetic shutter 40 is disposed in a fixed relationship with the housing 10 such that it is disposed on one edge thereof proximate to the surface of the delivery roller 26. The electromagnetic shutter 40 has a south pole 42 and north pole 44, the south pole 42 leading the north pole 44. In the preferred embodiment, the tips of the two poles 42 and 44 are disposed away from the surface of the delivery roller 26 a distance of between one to two millimeters. Additionally, it is disposed proximate to the "north" pole of the permanent magnet 30, the positioning thereof described herein in detail.

The electromagnetic shutter 40 has a single winding, 48, disposed on the respective pole 42. The electromagnetic shutter 40 is operable to be connected to a control system 52, which control system 52 is operable to turn the electromagnetic shutter 40 on and off. The control system 52 can reverse the polarity of the electromagnet by changing the direction of the current applied to the windings which can produce the thickness of the developer flow to alter operating characteristics.

In operation, the delivery roller 26 is operable to have the outer roller member 32 rotate at a speed of approximately 200 millimeters per second. The toner particles are aligned along the tangential magnetic field on the surface of the roller member 32, such that they will be delivered to the surface of the PC drum 12. In order to prevent "clumping" of toner particles on the surface of the member 32, a mechanical blade 54 is provided on the peripheral edge of the opening 28 of the housing 10 and disposed parallel to the delivery roller 26. The blade 54 has a distal end that is disposed a distance of 0.6–0.7 millimeters away from the surface of a member 32 to provide a delivery gap.

Figure 2:
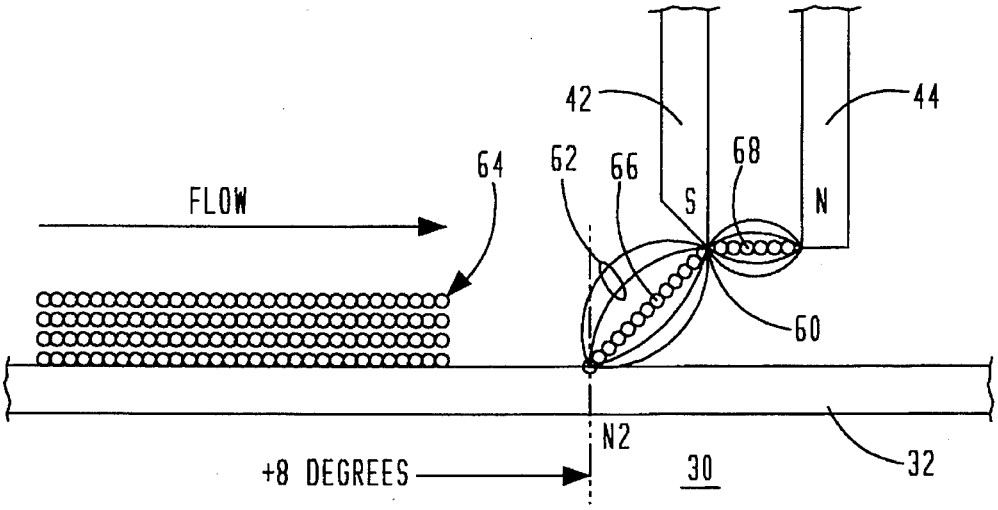
FIG. 2 illustrates a diagrammatic view of one orientation of the electromagnetic shutter.

Referring now to FIG. 2, there is illustrated a diagrammatical view of the south and north poles 42 and 44, respectively, in proximity to the rotating member 32 and the magnetic field associated therewith. The poles on the permanent magnet 30 are illustrated as being poles N1, N2, S1, S2 and S3. Pole N2 is the most proximate to the tips of the poles 42 and 44 and pole N1 is disposed proximate to the opening 28. Pole S1 is disposed between poles N1 and N2 and poles S2 and S3 are disposed sequentially between N1 and N2 in that order. It is the relationship of pole N2 to the south pole 42 of the electromagnetic shutter 40 that is important for the present invention. The south pole 42 is noted as having a sharp point 60 disposed on the edge of the south pole 42 proximate to the north pole 44. In the embodiment of FIG. 2, the north pole N2 of the magnet 30 is at a position of approximately +8°, the "+" indicating a position relative to the south pole 42 of the electromagnetic shutter 40 that is "lagging" the flow, i.e. to the leer with a counter clockwise rotation. The field lines associated with the pole N2 and the south pole 42 at the tip 60 are denoted by a reference numeral 62. Additionally, there are tangential fields that are the result of the north and south poles of the magnet 30, these resulting in tangential field lines (not shown) along the surface of the member 32. These tangential field lines allow toner particles 64 to align along the surface thereof. As they approach the field lines 62, they will align between the north pole N2 and the south pole 42 to create a "dam" 66. Additionally, some toner particles 68 will be disposed between the south pole 42 and the north pole 44 along the field lines between the gap therein. Therefore, whenever the electromagnetic shutter 40 is turned on, the field lines 62 will be generated and cause a buildup of toner particles in the dam 66.

Figure 3:
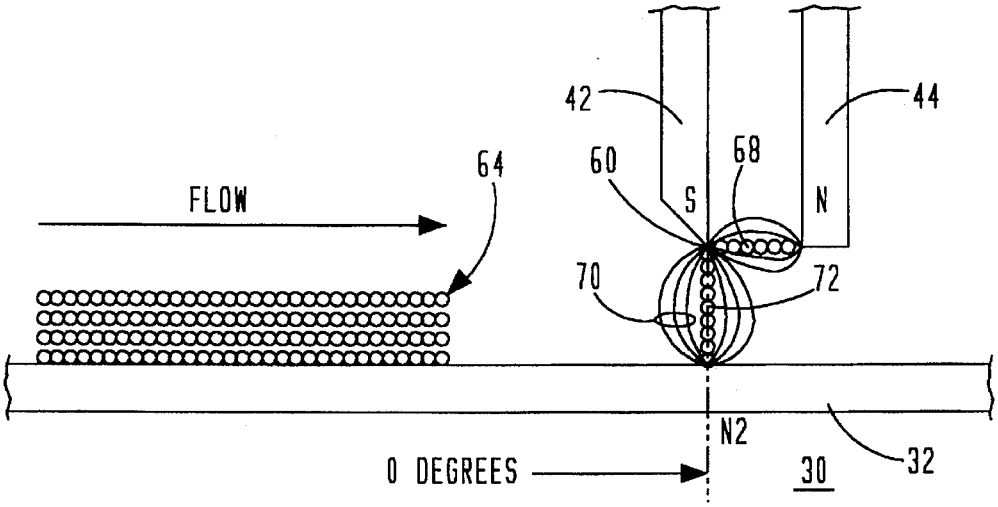
FIG. 3 illustrates an alternate position to that of FIG. 2.

Referring now to FIG. 3, there is illustrated a similar configuration to that of FIG. 2, with the exception that the south pole 42 is disposed in line with the north pole N2 of the magnet 30. This results in field lines 70 and a dam 72, which is normal to the flow of the developer particles 64, in addition to the position of the north pole N2 aligning with the sharp point 60 at the 0° reference position.

Figure 4:
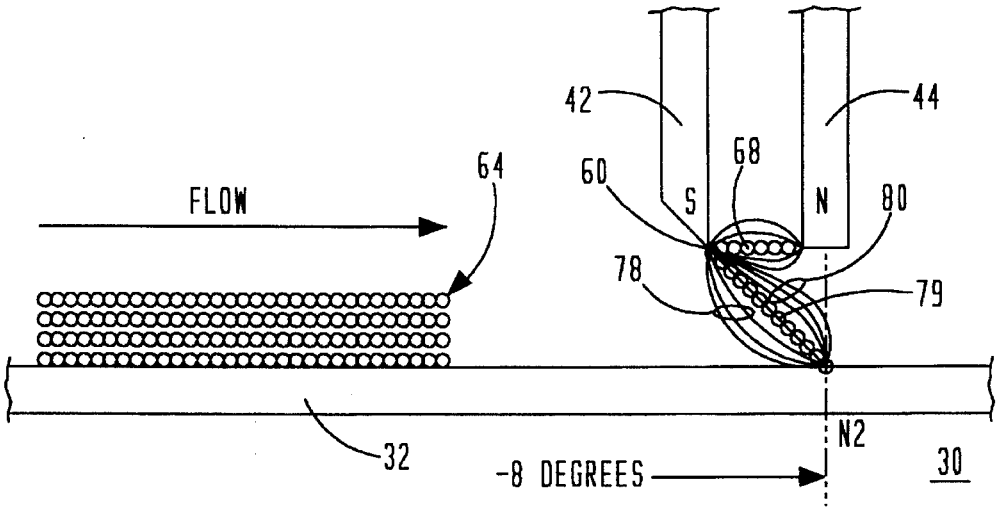
FIG. 4 illustrates an alternate embodiment for FIGS. 2 and 3.

Referring now to FIG. 4, there is illustrated an alternate embodiment wherein the pole N2 of the fixed magnet 30 "leads" the south pole 42. In this manner, field lines 78 are provided between the pole N2 and the tip 60 of the south pole 42 to form a "dam" 79 of developer particles. This results in the field lines 78 proximate to the north pole 44 being "compressed". This is represented by a point 80 on the field line 78. This compression is due to the field lines between the south pole 42 and the north pole 44 that create the string of toner particles 68. As will be noted herein in with the description of test results, this pole position of −8° is the optimum pole position. It is believed that when the pole N2 is positioned prior to the poles 42 and 44 of the electromagnetic shutter 40, that the resulting field lines between pole 40 and N2 are too weak to stop all developer flow. When the pole N2 of the magnet 30 is disposed in a line with south pole 42, the field lines generated on the surface of the roller member 32 are also too weak to stop all developer flow. However, when the magnet pole N2 is positioned across from its similar pole, the north pole 44, the "wedge" effect of the developer occurs. This results in the strongest field. This is due to the fact, it is believed, that the magnetic field of the two like poles reshape the field lines between the south pole 42 and the two north poles N2 and 44. The compression of the field lines creates a dense lateral magnetic field between the N2 pole of the magnet 30 and the south pole 42 of the electromagnetic shutter 40. The lateral magnetic field strength is increased and creates a wall of developer, the dam 79, that has a larger force component to oppose the oncoming developer flow. The developer flow takes the path of least resistance and falls back into the developer sump 14. This shearing effectively is maximized by the summation of magnetic field strength in the opposite direction of developer flow.

Various tests were performed at different currents, pole positions and gap widths. They are described hereinbelow with reference to Table 1–Table 9. For these experiments, the wire size used was a 28 AWG, and 30 AWG. Tables 1–6 use a combination of 28 and 30 AWG wound on south pole 42 with 310 turns of each wire. Tables 7–9 use only 30 AWG with a total of 517 turns on south pole 42. Using a single pole for windings allowed for easier assembly and a smaller profile. The rating was as follows:

Below average: 1

Average: 2

Above Average: 3

Excellent: 4

TABLE 1

| | | CURRENT A | | | | |
|---|---|---|---|---|---|---|
| GAP | POLE POSITION | 0.14 | 0.21 | 0.27 | 0.33 | 0.41 |
| 1 mm | 0° | 1 | 1 | 2 | 3 | 4 |
| 1 mm | 5° | 1 | 1 | 2 | 3 | 3 |
| 1 mm | −5° | 2 | 2 | 3 | 4 | — |
| 1 mm | −10° | 2 | 2 | 3 | 4 | 4 |
| 2 mm | 0° | 1 | 2 | 2 | 3 | 3 |
| 2 mm | −5° | — | 1 | 2 | 2 | 3 |
| 2 mm | 5° | 2 | 2 | 3 | 3 | 4 |

TABLE 2

| | CUR- | POLE POSITION | | | | | | | | |
|---|---|---|---|---|---|---|---|---|---|---|
| GAP | RENT | 10 | 7 | 5 | 3 | 0 | −3 | −5 | −7 | −10 |
| 1 mm | 0.3 A | 4 | 4 | 4 | 3 | 3 | 3 | 3 | 4 | 4 |
| 1.5 mm | 0.3 A | 4 | 4 | 3 | 3 | 3 | 3 | 2 | 2 | — |
| 2.0 mm | 0.3 A | — | — | 3 | 3 | 2 | 2 | 2 | 2 | 2 |

TABLE 3

| | | POLE POSITION | | | | | | | |
|---|---|---|---|---|---|---|---|---|---|
| GAP | CURRENT | 15 | 12 | 10 | 8 | 6 | 4 | 2 | 0 |
| 1.5 mm | 0.3 A | 2 | 2 | 2 | 2 | 2 | 2 | 2 | 2 |

TABLE 4

| | | POLE POSITION | | | | | | | |
|---|---|---|---|---|---|---|---|---|---|
| GAP | CURRENT | −2 | −4 | −6 | −8 | −10 | −12 | −15 | −18.75 |
| 1.5 mm | 0.3 A | 3 | 4 | 4 | 4 | 4 | 4 | 4 | 4 |

TABLE 5

| | | CURRENT (A) | | | | | | | |
|---|---|---|---|---|---|---|---|---|---|
| GAP | POLE POSITION | 0.3 | 0.28 | 0.26 | 0.24 | 0.22 | 0.2 | 0.18 | 0.16 |
| 1.5 mm | −8° | 4 | 4 | 4 | 4 | 4 | 3 | 3 | 3 |

TABLE 6

| | | CURRENT (A) | | | | | |
|---|---|---|---|---|---|---|---|
| GAP | POLE POSITION | 0.14 | 0.12 | 0.1 | 0.08 | 0.07 | 0.06 |
| 1.5 mm | −8° | 3 | 2 | 2 | 2 | 1 | 1 |

TABLE 7

| | | POLE POSITION | | | | |
|---|---|---|---|---|---|---|
| GAP | CURRENT | 0 | 2 | 4 | 6 | 8 |
| 1.6 mm | 0.3 A | 2 | 2 | 1 | 1 | 1 |

TABLE 8

| | | POLE POSITION | | | | | | |
|---|---|---|---|---|---|---|---|---|
| GAP | CURRENT | 0 | −2 | −4 | −6 | −8 | −10 | −12 |
| 1.6 mm | 0.3 A | 2 | 3 | 3 | 3 | 4 | 4 | 4 |

TABLE 9

| | | | | | | | |
|---|---|---|---|---|---|---|---|
| POLE POSITION | .0 | −2 | −4 | −6 | −8 | −10 | −12 |
| CURRENT (A) | 0.4 | 0.4 | 0.4 | 0.3 | 0.3 | 0.3 | 0.3 |
| RATING | 3 | 3 | 3 | 3 | 4 | 4 | 4 |

Figures 5, 6:
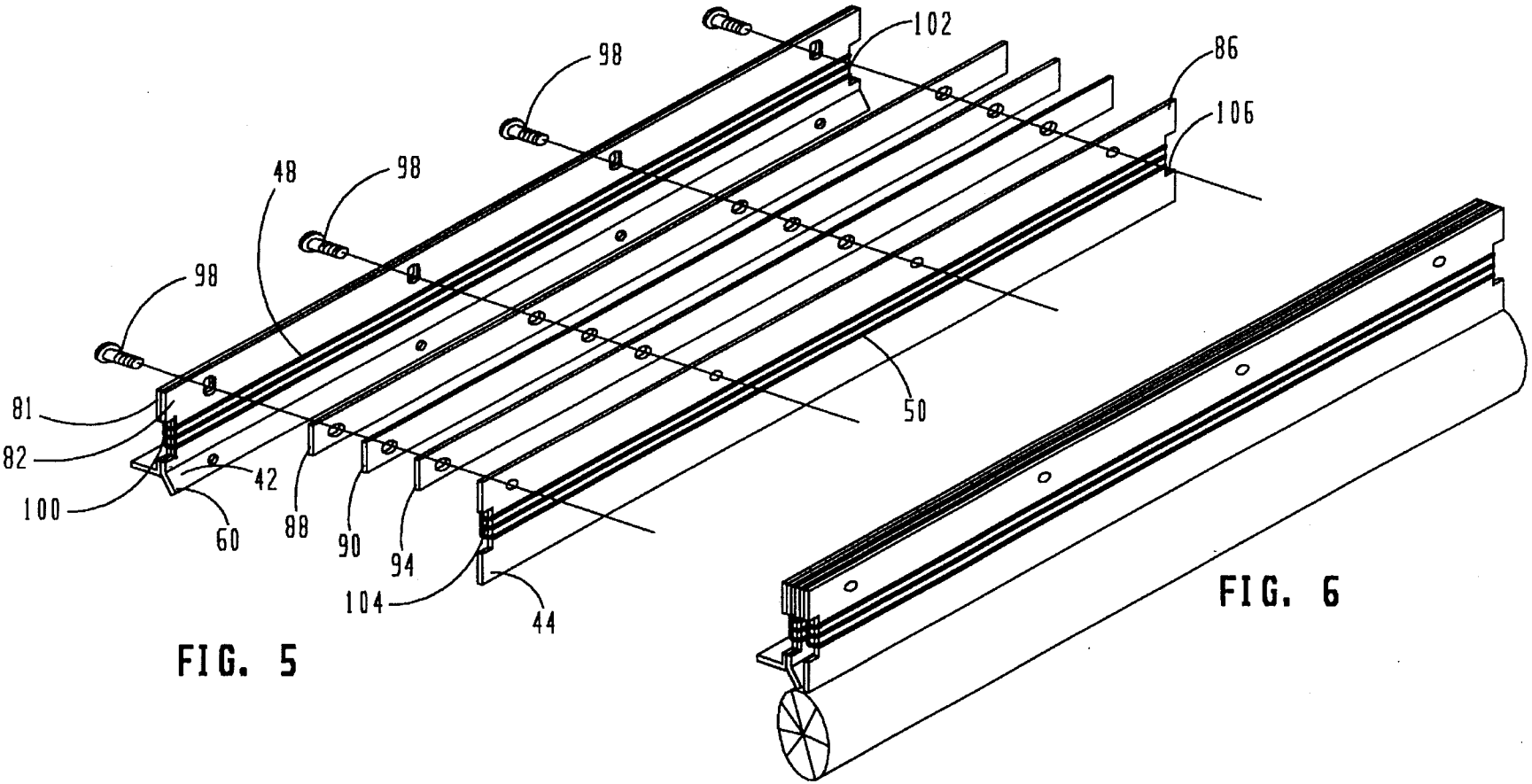
FIG. 5 illustrates an exploded view of the electromagnetic shutter.
FIG. 6 illustrates a perspective view of the assembled electromagnetic shutter proximate to the distribution roller.
Figure 7:
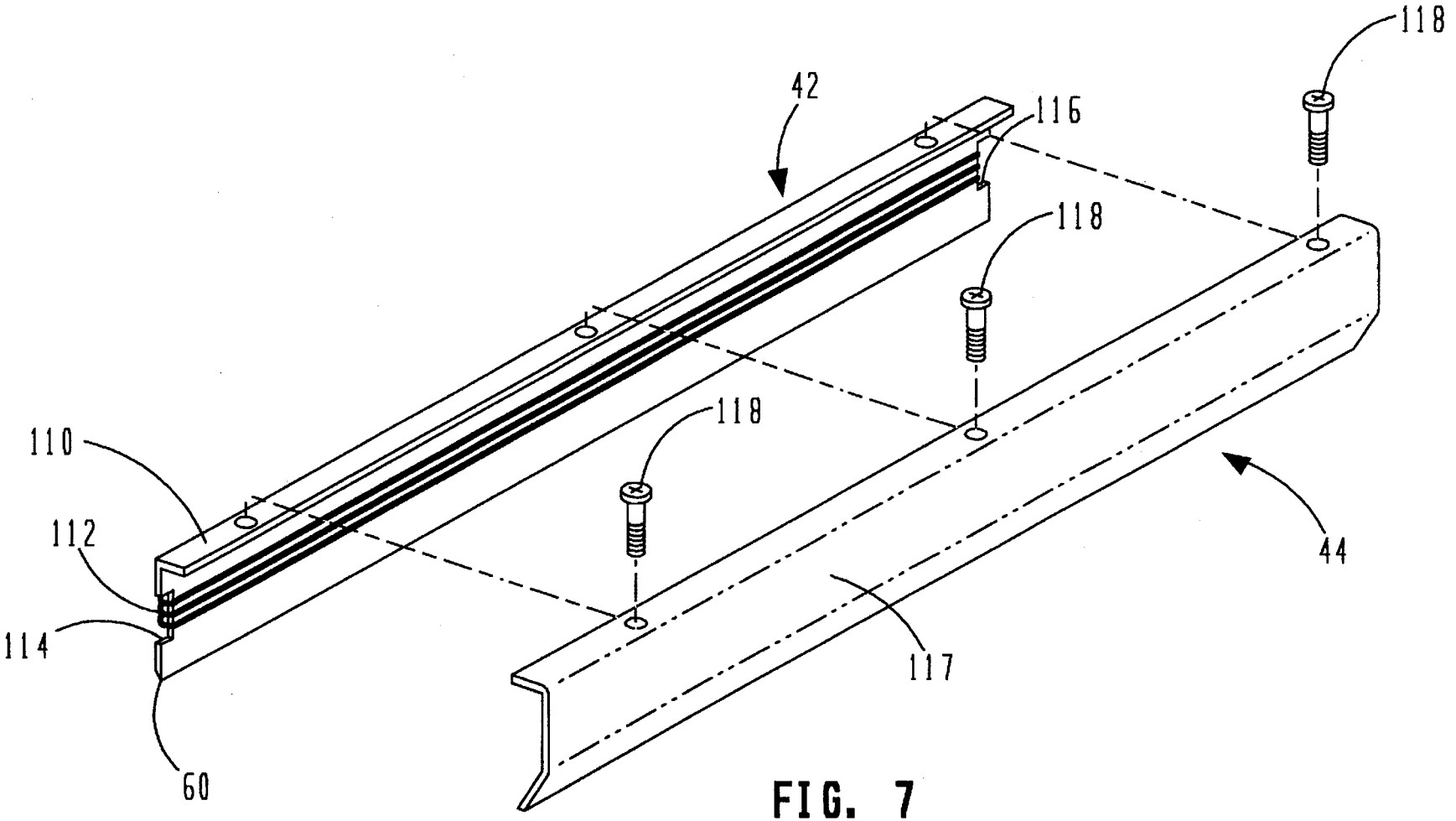
FIG. 7 illustrates an exploded view of the electromagnetic shutter with a single pole winding.
Figure 8:
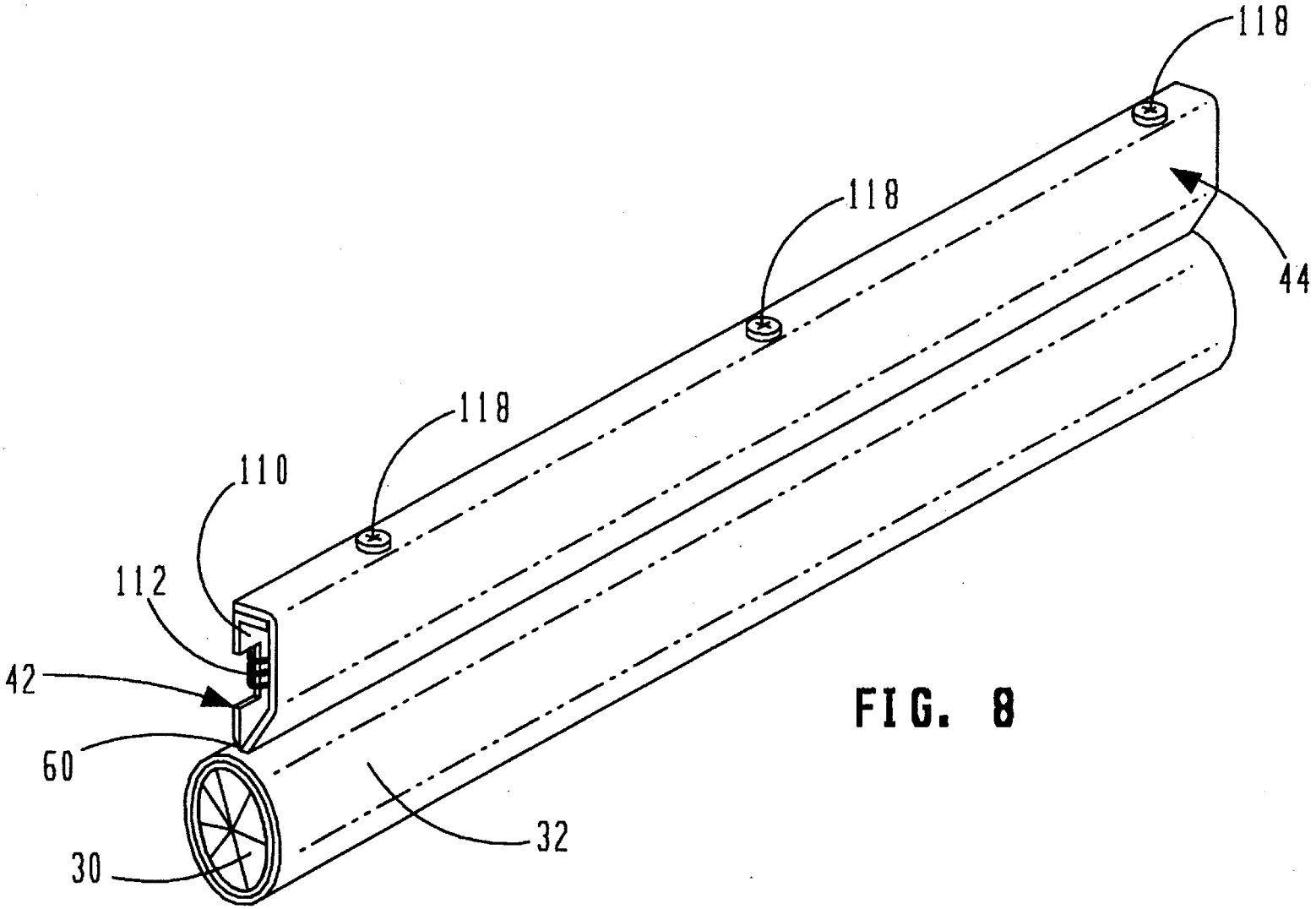
FIG. 8 illustrates a perspective view of the assembled electromagnetic shutter with a single pole winding proximate to the distribution roller.

Referring now to FIG. 5, there is illustrated an exploded view of the electromagnetic shutter 40. The shutter 40 is fabricated, as described above, from a south pole 42 and a north pole 44. The south pole 42 is fabricated from two pieces of sheet metal core of a 1.5 millimeter stock with reference numbers 81 and 82, the sheet metal piece 81 being a mounting block and the sheet metal piece 82 forming the south pole 42 at the lowermost peripheral edge thereof, this inclined at an angle and the edge thereof tapered to provide the point 60. This edge, as described above, allows for concentrating the field lines at a point. The north pole 44, similarly, is fabricated from a piece of 1.5 millimeter sheet metal stock 86. All three sheet metal strips, 81, 82 and 86 are longitudinal and are held together at the upper side thereof by three sheet metal spacers, 88, 90 and 94. They are all secured with screws 98. When the two sheet metal strips 81 and 82 are disposed together, there are two notches 100 and 102 formed therein which provide alignment for the windings 48 and, similarly, the sheet metal strip 86 forming the north pole 44 has two notches 104 and 106 disposed thereon for containing the winding 50. There are 250 windings of 32 AWG wire for each of the windings 48 and 50, these being attached to a control system that is operable to activate the windings when a field is desired and deactivate the windings when a field is not desired. The assembled system is illustrated in FIG. 6. In addition, the electromagnetic shutter can be simplified as seen in FIGS. 7 and 8. The windings can be attached to only one pole. The net effect is the same.

Referring now to FIG. 7, there is illustrated the simplified assembled system showing an exploded view of the electromagnetic shutter 40 which utilizes a single pole design. In this design, there is illustrated a first plate 110 with a winding 112 disposed thereabout. The winding 112 is disposed about the longitudinal axis of the plate 110 in an indented area 114 on one side and an indented area 116 on the other side. This comprises the south pole 42 with the sharp edge 60 disposed on the plate 110. A second plate 117 provides the north pole 44. Screws 118 are provided to hold the two plates 112 and 117 together. The assembled view is illustrated in FIG. 8.

In summary, there has been provided an electromagnetic shutter that is utilized in conjunction with a developer module in an electrophotographic print engine. This electromagnetic shutter operates to place a magnetic field in line with the flow of toner particles about a delivery roller in a developer module and extending upward from the surface thereof. When this magnetic field is placed in the path of a developer flow, a magnetic dam is created. This magnetic dam prevents the developer particles from moving out of the delivery port, and therefore, effectively inhibits developer flow.

Although the preferred embodiment has been described in detail, it should be understood that various changes, substitutions and alterations can be made therein without departing from the spirit and scope of the invention as defined by the appended claims.

What is claimed is:

1. A developer module with an electromagnetic shutter, comprising:

a sump housing for containing electrostatic toner particles and having an opening;

a delivery device having a movable surface for conveying developer on said movable surface from the interior of said sump housing to a photoconductive element operable to carry a latent image, said delivery device having a fixed magnetic device associated therewith with at least one pole of a first polarity fixed relative to the movement of said movable surface such that the developer particles are magnetically aligned along said movable surface of said delivery device; and a magnetic damming device having a surface disposed at a predetermined distance above said movable surface, to create a substantially fixed gap, said magnetic damming device for selectively creating a magnetic field in the path of the developer flow across said gap, thus creating field lines that extend upward from the movable surface of said delivery device from said at least one pole such that the developer particles align themselves with the created magnetic field when selectively created.

2. The developer module of claim 1, wherein said delivery device comprises a roller.

3. The developer module of claim 2, wherein said fixed magnetic device comprises a cylindrical magnetic device poled with different magnetic poles having at least one pole of said first polarity and at least one pole of a second polarity opposite said first polarity, such that said electrostatic developer particles magnetically align themselves along the surface of said roller.

4. The developer module of claim 3, wherein said roller comprises a hollow cylindrical tube of a non-magnetic material.

5. The developer module of claim 1, wherein said damming device has at least one pole of opposite polarity to said first polarity and disposed above the surface of said delivery device a predetermined distance and proximate to said one pole of said fixed magnetic device, said one pole of said damming device switchable such that said created magnetic field can be turned off and turned on.

6. The developer module of claim 5, wherein said damming device includes a second pole of said first polarity disposed proximate to said one pole of said damming device of said opposite polarity to said first polarity and disposed such that the field lines created therebetween are substantially parallel to the surface of said delivery device.

7. The developer module of claim 6, wherein said second pole of said damming device is aligned in an offset position relative to said one pole of said magnetic device.

8. The developer module of claim 7, wherein said offset is such that said first pole of said damming device lags said one pole of said fixed magnetic device such that the created field lines align the developer particles at an angle that is less than 90° to the flow of developer particles.

9. The developer module of claim 6, wherein said damming device is operable to have the polarity of said first pole switched to said first polarity and the polarity of said second pole switched to said opposite polarity to alter the characteristics thereof.

10. A method for controlling the flow of developer from a toner housing containing electrostatic developer particles to a delivery device having a movable surface, comprising the steps of:

creating a fixed magnetic device in close association with the surface of the delivery device with at least one pole of a first polarity fixed relative to the movement of the movable surface of the delivery device such that developer particles are magnetically aligned along the movable surface of the delivery device;

disposing a magnetic member above the movable surface of the delivery device to form substantially fixed gap; and magnetically damming the flow of developer particles from the housing by creating a magnetic field that extends outward from the movable surface of the delivery device and upward from the at least one pole to the magnetic member such that the developer particles align themselves with the created magnetic field to create a dam of developer particles.

11. The method of claim 12, wherein the delivery device comprises a roller and the fixed magnetic device comprises a cylindrical magnetic device poled with different magnetic poles having at least one pole of the first polarity and at least one pole of a second polarity opposite the first polarity, such that the electrostatic developer particles magnetically align themselves along the surface of the roller.

12. The method of claim 10, wherein the steps of magnetically damming and disposing the magnetic member above the movable surface of the delivery device disposing an electromagnet above the surface of the delivery device and having at least one pole of the opposite polarity to the fist polarity, at least one pole disposed above the fixed pole associated with the delivery device a predetermined distance and the poles operable to be switched on and off.

13. The method of claim 12, wherein the electromagnetic has a second pole disposed adjacent to the first pole and above the surface of the delivery device such that the field lines created therebetween are substantially parallel to the surface of the delivery device.

* * * * *